United States Patent [19]

Deaton et al.

[11] Patent Number: 4,471,596

[45] Date of Patent: Sep. 18, 1984

[54] VAULT GRID

[76] Inventors: Charles U. Deaton, 24501 Ski Hill Dr., Golden, Colo. 80401; Lloyd H. Anderson, 11791 W. Jewell Ct., Lakewood, Colo. 80228

[21] Appl. No.: 410,439

[22] Filed: Aug. 23, 1982

[51] Int. Cl.[3] ..... F21V 13/00

[52] U.S. Cl. ..... 52/668; 52/28; 362/319; 362/354

[58] Field of Search ..... 52/28, 668, 484, 83; 362/317, 319, 354, 342

[56] References Cited

U.S. PATENT DOCUMENTS

| | | | |
|---|---|---|---|
| 2,837,632 | 6/1958 | Lipscomb | 362/342 |
| 3,024,355 | 3/1962 | Lipscomb | 362/342 |
| 3,665,177 | 5/1972 | Brown et al. | 52/28 X |
| 3,736,418 | 5/1973 | Havlova | 362/354 X |
| 3,780,286 | 12/1973 | Alexieff et al. | 52/28 X |
| 3,798,446 | 3/1974 | Deaton | 52/28 X |

FOREIGN PATENT DOCUMENTS

| | | | |
|---|---|---|---|
| 693097 | 6/1953 | United Kingdom | 362/354 |

*Primary Examiner*—J. Karl Bell

*Attorney, Agent, or Firm*—Horace B. Van Valkenburgh; Jerry W. Berkstresser

[57] ABSTRACT

A grid which produces a vaultlike appearance on one side comprises a first series of parallel plates extending in one direction and a second series of parallel plates extending in the direction to intersect the first series of plates. At least one of the series of plates is generally concave on the one side; when only one series of plates is generally concave on the one side a tunnel effect is produced with the side edges generally concave, but when both series of plates are generally concave on the one side, a dome appearance is produced. The grid may be used as a ceiling grid and illuminated, if desired, or as an upright partition or divider placed on one edge. The opposite edges of the plates may be equidistant, including any deviations from a curve on which the edges may be laid out. A series of scallops, concave on the one side and convex on the opposite side of each plate may have the length corresponding to the distance between intersecting plates. When used as a ceiling grid, illuminated from above, the distance between plates of each series may be and, when a tunnel effect is produced, is proportioned so that the angle of cutoff of light is the same.

20 Claims, 12 Drawing Figures

VAULT GRID

This invention relates to vault grids and more particularly to such vault grids which may optionally be illuminated.

BACKGROUND OF THE INVENTION

There are numerous types of what are referred to as "egg-crate" grids, i.e. having continuous or discontinuous baffles arranged in a rectangular, perpendicular relationship with equal squares surrounded or outlined by adjacent intersecting baffles. The baffles need not be continuous, but merely give the impression of rectangular spaces, two outstanding examples of this type being those of U.S. Pat. No. 3,774,024, in which the grid is formed by individual pieces which overlap laterally to provide light interception but may be turned into straight rows to facilitate cleaning, and U.S. Pat. No. 4,021,985, in which secondary baffles are formed from slots in parallel primary baffles and turned to 90° positions. Arcuate, concave baffles have been proposed, such as parallel rows of concave, transversely arcuate panels between lights, with concave, arcuate panels also extending downwardly on a wall, as in U.S. Pat. No. 4,083,153. A series of inwardly concave elements, relatively short in height, have been proposed as shades for a light, with circular rows of such elements surrounding the light and the radius of the arc increasing for successive rows, as in U.S. Pat. No. 3,736,418. A cellular light control panel, molded of plastic or the like, has intersecting walls which are formed in a tunnel shape, as in U.S. Pat. No. 3,024,355, but the height of each wall, at the intersecting positions, must vary from the center to each edge in order to obtain the same angle of light intersection for each cell. A dome shape is formed by one side of a cellular light control structure, again molded of plastic or the like, in U.S. Pat. No. 3,024,355, but the four outer edges of the structure are in the same plane and again the same variation in height at each intersection of the cellular walls is necessary. As far as is known, there is no dome-shaped grid structure, or one for which illumination is optional, whose outer edges are generally concave or whose intersecting plates may be the same height at each intersection, or a vaulted grid structure whose intersecting plates may be the same height at each intersection.

A principal object of this invention is to provide a vaulted or dome-shaped grid which does not require the formation of a plate into a laterally curved configuration; to provide such a vault grid for which a series of plates may be left in flat or planar condition but be generally concave on one side with the opposite side generally parallel thereto; to provide such a vault grid which may optionally be illuminated, either from above or below, as by light fixtures or even a skylight; to provide such a vault grid which comprises two series of intersecting plates with the height of the plates being substantially the same at each intersection; to provide such a vault grid in which the angle of light cutoff between plates may be made substantially equal for each of the spaces between adjacent plates without affecting the equal heights of the plates at intersections; to provide such a vault grid, the underside of which has a dome shape with the side edges being concave on the dome side; to provide such a vault grid which is supported in such a manner that, when illuminated, access to light fixtures above the grid, is readily obtainable; to provide such a vault grid which may be formed from individual plates capable of being mass produced on a consistent and accurate basis; and to provide such a vault grid which is conveniently and economically manufactured.

SUMMARY OF THE INVENTION

A grid of this invention, adapted to produce a vaultlike appearance on one side and adapted to be used as a ceiling grid and illuminated, as from above, if desired, or as an upright partition or divider, on one edge, comprises a first series of parallel plates extending in one direction and a second series of parallel plates extending in a direction to intersect the first series of plates. The plates of the first and second series of plates are formed as an assembly and are supported in positions such that one side of the assembly produces the vault appearance. At least one series of plates is generally concave on the one side; when only one series of plates is generally concave on the one side, a tunnel effect is produced, but when both series of plates are generally concave on the one side, a dome appearance is produced. A single grid, vaultlike on the one side, may be formed from a single assembly of plates, in which the end edges of each plate extend to opposed outer edges of the assembly. However, the assembly may be formed by four quadrants, particularly when both series of plates are generally concave on the one side, each quadrant abutting an adjacent quadrant at the center point of an outer edge of the assembly and the edges of the quadrants intermeshing with edges of the remaining quadrants centrally of the assembly. A ceiling grid for a larger space may be formed by a plurality of such assemblies or sections. The plates may be made uniform in height, proportions and length, in which event the plates may be placed so that the spacing between adjacent plates increases as the plates recede from each outer edge to a position abutting the adjacent quadrant. For a ceiling grid so constructed, the angle of cutoff of light incident from above, determined by a ray of light which will pass over one plate and beneath the next adjacent plate, will be the same for each of the spaces between plates. When the ceiling grid plates are positioned along an ascending arc, such as having a radius equal to the chord of the arc, the difference in elevation between adjacent plates will decrease as the position of the plates change from a lower point on the arc to the center of the arc, so that the distance between plates will increase toward the center of the arc to provide the same angle of light cutoff.

The lower and upper edges of the plates of such a ceiling grid are preferably vertically equidistant, including any deviations from an arc on which the edges may be laid out. Thus, a series of scallops, concave on the underside and convex on the upper side of each plate and having a length corresponding to the distance between intersecting plates, may be provided. Individual scallops may be produced along an arc whose height, measured from the chord of the arc, is the same for each of the scallops, although numerous variations are possible. Thus, the lower and upper edges of the plates may conform to the arc on which laid out, to the chord of this arc, or any other desired deviation, upwardly or downwardly, with the configuration between two intersecting plates being the same or different from the configuration between other intersecting plates. The outer corners of the underside of a section are normally the lowest points, while the center of a section dome is normally the highest point of the underside and each center of each side of a section, when square, is intermediate in elevation.

The plates may be produced from a flat sheet of metal, with cutting dies utilized first to cut the scallops or other configurations along the bottom edge, then the sheet moved a distance equivalent to the height of the plate, when the next series of scallops or configurations are cut. Thus, the edges of the plates will be geometrically identical. The second cut produces both the convex, upper scallops for the plate whose lower scallops have been previously cut, as well as the concave scallops for the next plate. The assembly of quadrants or a section may be supported from beams or the like with adjustable supports for at least the outer corners of each section. The vault grid may be illuminated from above, as by fluorescent light fixtures or a skylight, although illumination may be from below or from either side. When illuminated from above by light fixtures and a section consists of four quadrants, two diagonally opposed quadrants may be supported so as to be more readily removable for access to the light fixtures, with the remaining diagonally opposed quadrants being relatively fixed in position.

THE DRAWINGS

DESCRIPTION OF THE PREFERRED EMBODIMENT

Figure 1:
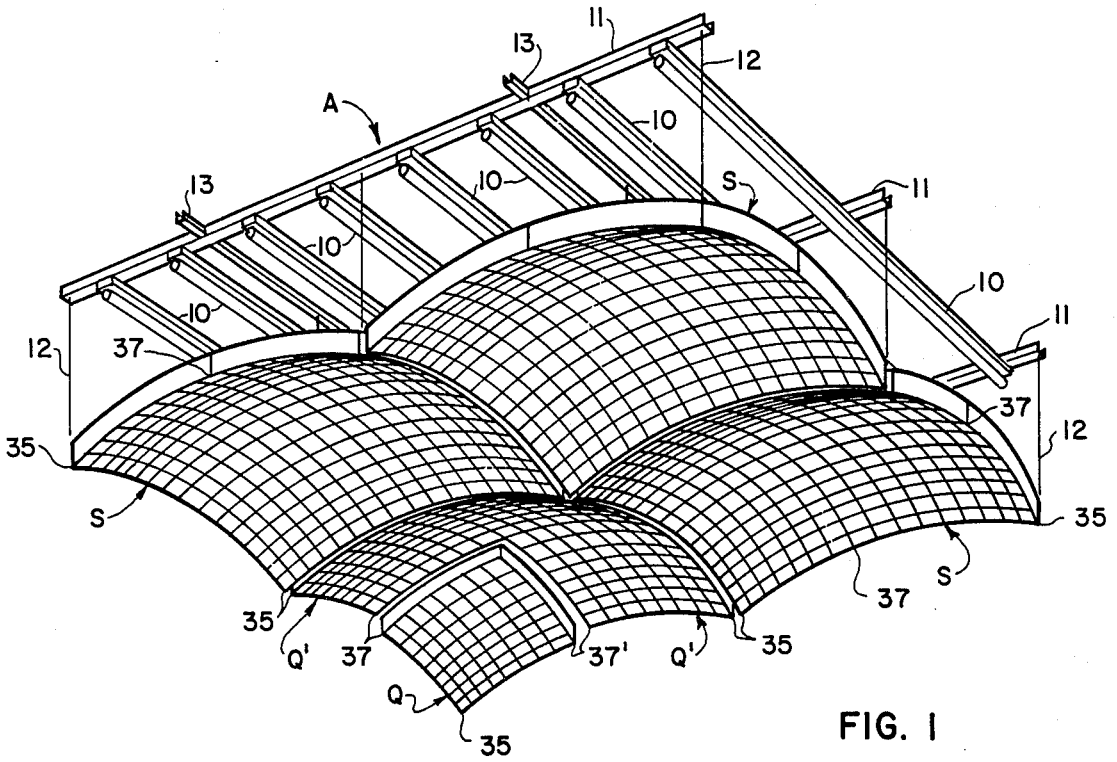
FIG. 1 is an underside perspective view of a series of dome grids beneath ceiling or portion thereof, constructed in accordance with this invention, with one quadrant of a section of one grid structure being displaced downwardly for clarity of illustration in connection with FIG. 2.
Figure 2:
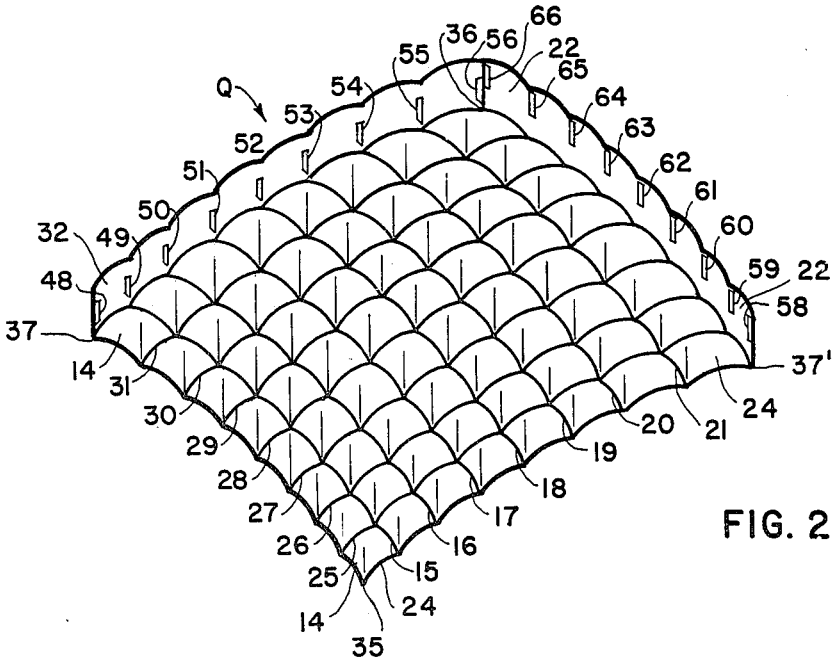
FIG. 2 is an underside perspective view of the quadrant of a section of the grid structure of FIG. 1 which is displaced downwardly.

A vault ceiling grid constructed in accordance with this invention and adapted to produce a domelike appearance on the underside, as illustrated in FIG. 1, may include a series of sections S, each of which may be rectangular but preferably square in shape, with the number of sections depending upon the area of the space, normally a room or hall in which the dome grid is installed. Thus, the four sections S, shown in FIG. 1, are illustrative only, since the number of sections will vary with the area to be covered. Each of the sections S may include four quadrants, such as the quadrant Q, which is shown as dropped from its normal position for correlation with the illustration of quadrant Q in FIG. 2, on an enlarged scale and permitting slightly more details to be shown, as well as to illustrate the removal of one or two quadrants only to obtain access to the area above the section from which the quadrant is removed. When the ceiling grid is illuminated, as by light fixtures 10 of FIG. 1 placed above the grid, opposed quadrants Q may be more readily removable, as in a manner described later, while the remaining opposed quadrants Q' may be relatively fixed. It will be understood that all of the quadrants may be identical in construction and that quadrants Q and Q' have been identified as such solely for the purpose of distinguishing between the manner of installation thereof. It will also be understood that a section S, if desired, may be a single piece or two half pieces, without being divisible into quadrants.

Figure 7:
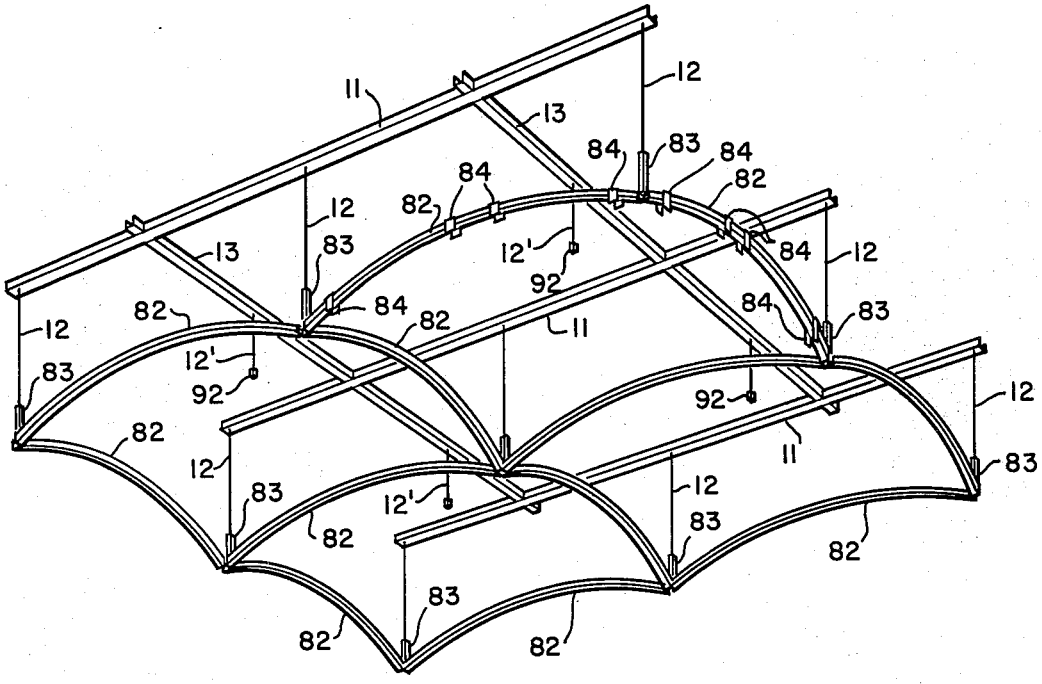
FIG. 7 is a perspective view, looking obliquely from underneath, of a suspension structure for the dome grid of FIG. 1, utilizing inverted channels in accordance with this invention.

A supporting assembly A is mounted above the sections S and may include the series of light fixtures 10, normally elongated fluorescent light fixtures, which are supported from the underside of a plurality of beams 11. The sections S are suspended from the supporting assembly A in a suitable manner, as by cables 12 depending from the beams 11, for which rods or any other suspension member may be substituted. A series of cross beams 13 stabilizes the beams 11, may merely extend between and be attached to the beams 11, or may also be attached to the ceiling, to which the beams 11 may also be attached. Also, the cross beams 13 may extend across the space in which the vault grid is installed, as from wall to wall and, in turn, support the beams 11. The beams 11 and cross beams 13 are also shown in FIG. 7, other details of which will be described later, including the support of the center corners of relatively fixed quadrants Q' from cross beams 13. As illustrated diagrammatically in FIG. 3, each quadrant, such as quadrant Q, may include a series of flat plates 14 through 22, inclusive, disposed in parallel relation and with one end lower than the opposite end. Plates 14–22 are installed so that at the lower end of each a transversely disposed plate 24 is intersected, while transverse plates 25 through 32, inclusive, are similarly intersected by each of plates 14–22. Each of the plates 14–22 and 24–32 is flat and planar, being placed on edge, i.e. in a vertical position. Thus, the plates 24–32 appear as straight lines in FIG. 3. As also shown in FIG. 4, each of the plates is provided with a lower scalloped edge 33 and an upper scalloped edge 34, with the scallops of lower edge 33 being concave and the scallops of the upper edge 34 being convex, while the opposed scallops on the lower and upper edges have corresponding lengths but these lengths increase from the lower end of each plate to its upper end. Although these plates are flat and planar, each is generally concave on the underside, or lower edge, while the scallops of the lower edges enhance the impression of curvature. On the quandrant Q of FIG. 2, the corner 35 at which plates 14 and 24 intersect is the lowest corner in elevation and corresponds to the lowest corners 35 of a section S on the underside, while the corner 36, at which plates 22 and 32 intersect, is the highest corner, i.e. at the center of the underside of a section S of FIG. 1. Similarly, the corner 37, at which plates 14 and 32 of quadrant Q intersect, and the corner 37', at which plates 22 and 24 intersect, are intermedicate in elevation and correspond to the midpoint 37 of each side of the underside of a section S, indicated in FIG. 1.

Figure 3:
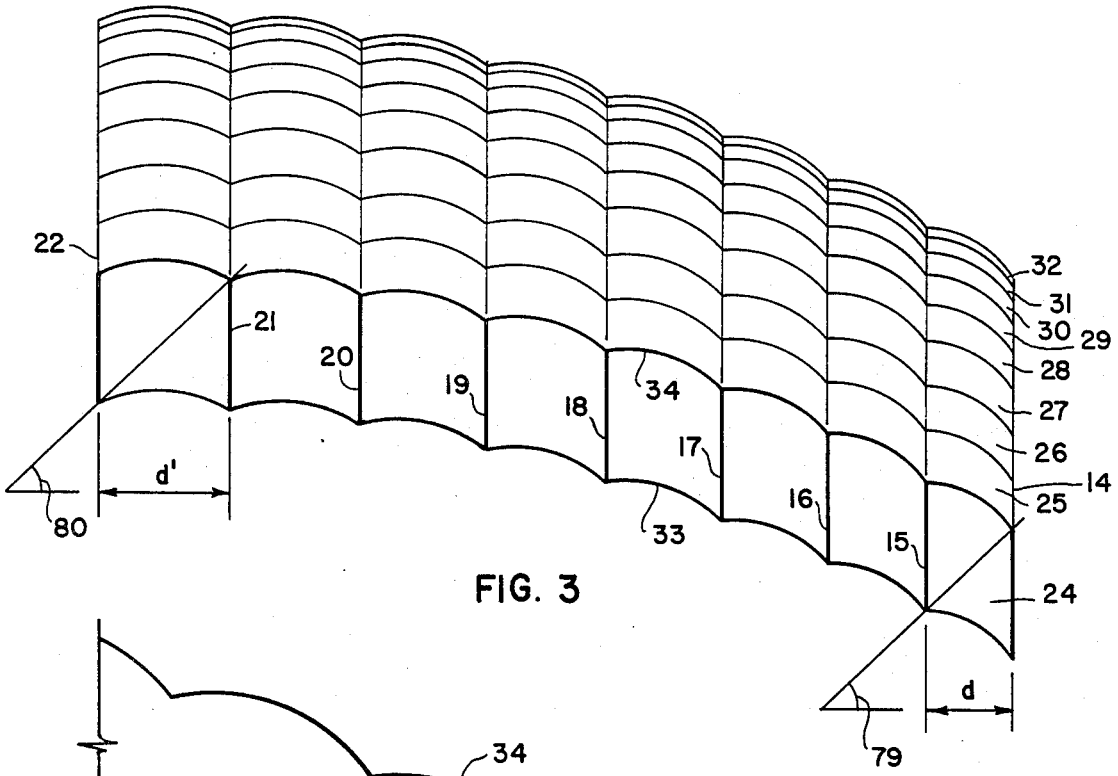
FIG. 3 is a diagrammatic representation of a front elevation, on a slightly larger scale, of the quadrant shown in FIG. 2, with a representation of the angles of light interference subtended by the upper and lower edges of adjacent plates from the area beneath the grid structure, at the inner and outer ends of one plate.
Figure 4:
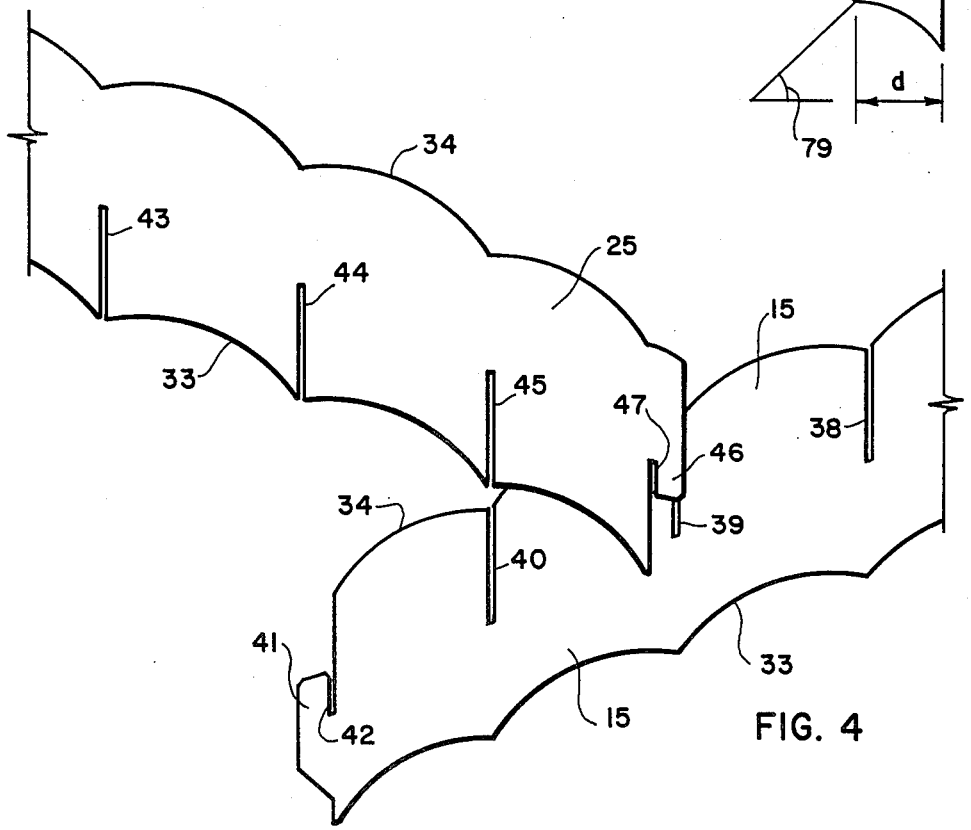
FIG. 4 is a perspective view, on a further enlarged scale, showing two of the planar plates of the quadrant of FIG. 3 in spaced, perpendicular relationship, prior to engagement in forming the quadrant of FIG. 3.

A portion of the lower end of each of the plates 15 and 25 of FIG. 3 are shown in FIG. 4, in perpendicular but separated position, one above the other, in order to illustrate the manner in which the intersecting plates may be connected. Thus, plate 15 may be provided with a series of downwardly extending slots 38, 39 and 40, with additional slots at unequally spaced positions to the opposite end of the plate, at the intersections of the upper scallops. Slots 38, 39 and 40 and similar slots in the remainder of the plate may extend downwardly for one half the distance between the intersection of adjoining scallops of upper edge 34, and the apex between scallops of lower edge 33 aligned therewith, although the proportional length of the slots may vary. At the lower end, a connection tab 41 is formed in alignment with the plate, with a short slot 42 separating an upper portion of the tab 41 from the remainder of the plate. This tab 41, as well as a similar tab at the opposite end of plate 15 may be bent over against the perpendicular plate which is intersected by plate 15, to attach the plates together, as will be described later. Similarly, in the embodiment shown, plate 25 is provided with a series of slots 43, 44 and 45 which extend upwardly from the apex of adjoining concave scallops along the lower edge 33 for one half of the distance to the intersection of the vertically aligned scallops of upper edge 34, with similar slots extending upwardly from the remaining apices of plate 25 between adjoining scallops of lower edge 33, and are positioned at increasing distances apart, i.e. in accordance with the width of the scallops corresponding thereto. The lower end of plate 25 is also provided with a tab 46, a lower portion of which is separated from the remainder of the plate by a short slot 47, so that the tab 46 and a similar tab at the opposite end of plate 25, may be bent over against the perpendicular intersecting plate for attachment purposes. As will be evident, the plates 14 and 15–22 are provided with intersecting, downwardly extending slots and end tabs similar to slots 38–40 and tab 41 of plate 15, while the perpendicular plates 24 and 25–32 are provided with upwardly extending slots corresponding to slots 43–45, and end tabs similar to tab 47, so that plate 25 may be moved downwardly in perpendicular relation to plate 15, with slots 40 and 45 in alignment. As a result, the lower half of plate 15 will be received within slot 45 and the upper half of plate 25 will be received within slot 40, while the upper and lower edges of the two plates, at the apex of the scallops of lower edges 33 and the intersection of the scallops of upper edge 34 will be at the same height. As will be evident, the remaining plates may be interconnected with the plates perpendicular thereto in a similar manner. Thus, the plate intersecting short slot 42, which will be plate 24 of FIG. 3, will also be at the same height, whereupon tab 41 may be bent over against plate 24 at the slot therein which corresponds to slot 45 of plate 25. In addition, short slot 47 of plate 25 will engage the slot of plate 14 corresponding to slot 40 of plate 15 so that tab 46 may then be bent over against Plate 14.

Figure 5:
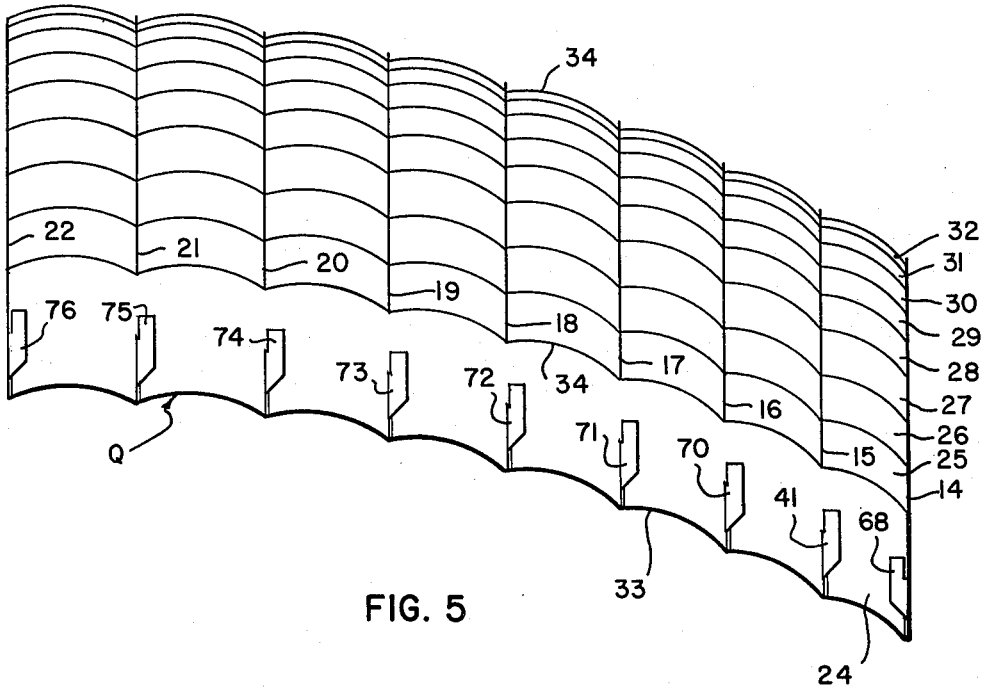
FIG. 5 is an end view of the quadrant of FIG. 2, on a larger scale, showing particularly the attachment connections between the plates.

In addition to the tabs 41 and 46 of FIG. 4, additional tabs may be bent over gainst an intersecting plate, at each end of each plate. Thus, the tabs 41 and 46 will be on the sides of the quadrant, (not visible in FIG. 2), but corresponding tabs, such as tabs 48–56 may be bent over against plate 32 from plates 14–22, inclusive, respectively. Similarly, tabs 58–66 may be bent over against plate 22 from plates 24–32, inclusive, respectively. As illustrated in FIG. 5, plates 14–22 may be connected to the plate 24 by tabs 68, 41 and 70 to 76, respectively.

Figure 6:
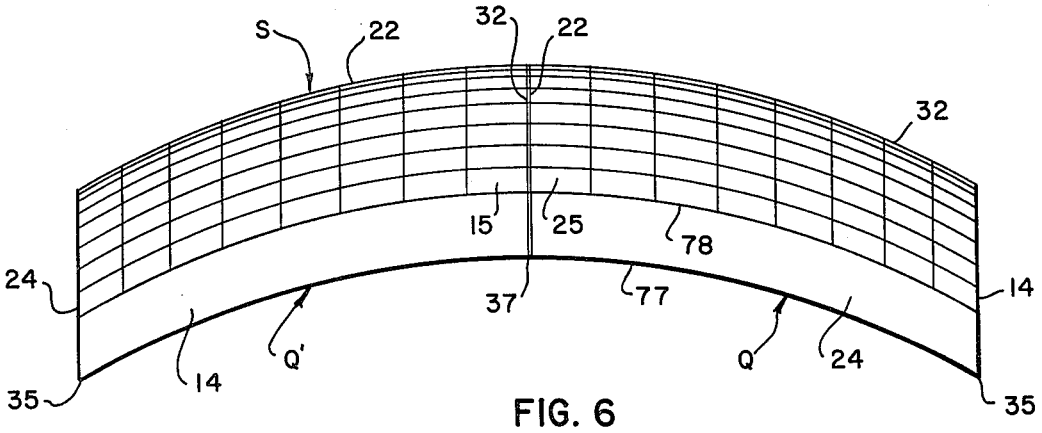
FIG. 6 is an end view, on a slightly enlarged scale, of a layout of one of the sections of the dome grid of FIG. 1.

In the layout of a section S, as in FIG. 6, an arc 77 represents the intersection of the scallops of a lower edge 33 of a plate of a quadrant, while a parallel arc 78 represents the intersections of the scallops of an upper edge 34 of the same plate. Similar lines represent similar intersections of scallops of other plates. Each section S may consist of a pair of removable quadrants Q and a pair of relatively fixed quadrants Q' disposed diagonally opposite each other, when light fixtures are mounted above and this is indicated in FIG. 6. However, it will be understood that quadrants Q and Q' are identical and each may remain fixed in position when there is no requirement for quick access to anything above the section. Thus, the only difference between quadrants Q and Q', as shown in FIG. 6, is that quadrant Q' has been rotated 90° from quadrant Q so that plate 14 is on the facing side, in alignment with plate 24 of quadrant Q, while plate 24 of quadrant Q' is opposite plate 14 of quadrant Q. Similarly, plate 22 of quadrant Q' is in alignment with plate 32 of quadrant Q and plate 32 of quadrant Q' abuts plate 22 of quadrant Q. The lowest point 35 on the underside of quadrant Q is opposite the lowest point 35 of quadrant Q', while intermediate points 37 of the two quadrants abut. Similarly, the two additional quadrants which will form the section S, but not shown in FIG. 6, will be another quadrant Q behind the quadrant Q' shown and another quadrant Q' behind the quadrant Q shown. The relationship between the quadrants not shown will be such that each is rotated through 90° from the adjacent quadrant, i.e. plate 32 of the opposite quadrant will abut plate 22 of quadrant Q' while plate 22 of the opposite quadrant will abut plate 32 of quadrant Q. It will also be noted that when each plate has the same arc at top and bottom as all other plates, the arc 77 will be the same arc as that connecting intermediate point 37 of each quadrant with the highest point 36, on the underside, and across the opposite quadrant to the center of the opposite side of the section S. In other words, in the construction shown, the difference in elevation between the lowest point 35 and the intermediate side point 37 of each section is the same as the difference in elevation between the intermediate point 37 and the highest point 36, on the underside, i.e. at the center of the section S at the meeting point of the four quadrants.

The dome effect of each of the sections S is esthetically pleasing, particularly when the radius of the arc 77 of FIG. 6 has a ratio on the order of 1:1 to the chord of the arc. Thus, the preferred arcs 77 and 78 subtend an arc slightly less than one radian of the circle of which the arc is a portion. Of course, various architects may differ in judgment as to the most esthetically satisfying dome dimensions. After the ratio of the radius to the chord has been determined, the arc 77 determining the location of the lower edge of a plate, such as the intersections of the scallops of a lower edge 33 of the plate, may be laid out. After the depth of the plates is selected, such as approximately 7% of the length of the chord, i.e. the width of the grid, the spacing between the two outer most plates, such as plates 14 and 15 of FIG. 3, is determined by the angle selected for view cutoff, represented by the angle 79 of FIG. 3. An angle of 45° to the horizontal, as shown, is, in a sense, arbitrary, since it can be and has been varied by individual architects, generally to a value between 35° and 45° to the horizontal. In any event, angle 79 is laid out from the upper edge of plate 14, at its intersection with arc 78 of FIG. 6, and projected to the arc 77 of FIG. 6, which determines the horizontal distance d between plates 14 and 15. Successive distances between plates are laid out in the same manner, for successive plates, as between plates 15 and 16, and so on until angle 80 between plates 21 and 22 is reached, which provides a distance d' between plates 21 and 22. Since plates 14–22 of FIG. 3 all have the same depth, it will be noted that the difference in elevation between the lower edge of plate 15, with respect to plate 14, is greater than for the difference in elevation between plates 15 and 16. Such difference in elevation becomes less for each successive pair of adjacent plates, until the uppermost plate 22, at the center of the section S, is reached, at which the greatest space between plates is obtained, but the view cutoff angle will remain the same. In view of the small difference in elevation between the lower end of plate 21 and the lower end of plate 22, the spacing between the plates may laid out in reverse, i.e. by first laying out distance d', by laying out angle 80 at 45° upwardly from the midpoint of arc 77, which will correspond to the lower edge of plate 22, then choosing a distance d' with regard to the depths of the plates, then laying out arc 78 at the point of intersection of angle 80 with a line representing distance d'.

After the length of the portions of arc 77, for instance, has been determined by the cutoff angles 79 and 80, as well as corresponding angles in between, the various scallops may be laid out. The radius of the respective scallops of the lower edges of the respective plates may be chosen so that the distance between the chord of the arc and the center of the arc is approximately the same for each scallop. Or, the radii of the successive scallops may be varied in proportion to the distance between plates. If desired, the radii may be selected so that each arc will subtend the same angle of the circle of which it is an arc. Also, some scallops may be laid out with different distances between the chord and the center of the arc. The scallops may be omitted and the arcs 77 and 78, or the chords of the scallops arcs, followed, as the edges of the plates, while other types of edge outlines at the area between plates intersecting the plate on which the outlines are produced, such as concave recessions or convex projections and variations in the outlines for alternate or other different areas, may be utilized. Other architectural variations may also be utilized.

The value of constancy in the angle of cutoff of light, from the center to the outer edges of each section, is that a person in the space above which the ceiling grid is hung, will very seldom look straight upwardly or at an angle greater than 45° upwardly, so that there is little opportunity for a lighting fixture or other construction to be seen directly. Furthermore, the scalloped configuration of the top of each plate is generally parallel to the scalloped configuration of the bottom of the same plate, so that there is a close approach to parallelism between the bottom of one plate and the top of the next plate. Thus, the angle of cutoff, such as represented by angles 79 and 80 of FIG. 3, will be substantially the same within each rectangle between each two pairs of intersecting plates.

In manufacturing the plates, such as plates 14–22 and plates 24–32 of FIG. 3, which are all of the same length and have correspondingly scalloped edges, it may be found desirable to provide a die which will cut the lower scalloped edges 33. Then, the stock may be moved a distance corresponding to the height of the plate and the concave scallops of edge 33 cut at the next set of scallops, so that the convex scallops produced by cutting the next set of concave scallops, will provide the convex scallops of the upper edge 34 of the previous plate. The slots and end tabs may then be cut from the respective plates so produced, so that provision may be made for cutting upwardly or downwardly extending slots and end tabs in appropriate positions.

Figure 8:
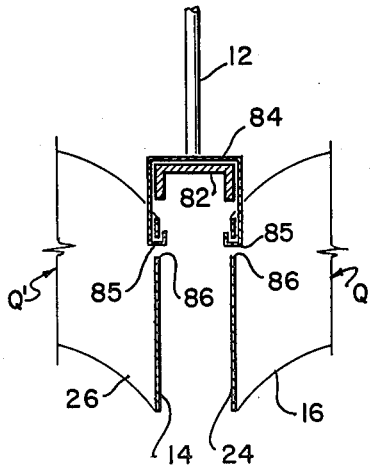
FIG. 8 is a fragmentary sectional view, on an enlarged scale, showing a portion of adjacent ends of two adjoining sections of the dome grid of FIG. 1, illustrating the manner in which the sections may be suspended from the structure of FIG. 7.
Figure 9:
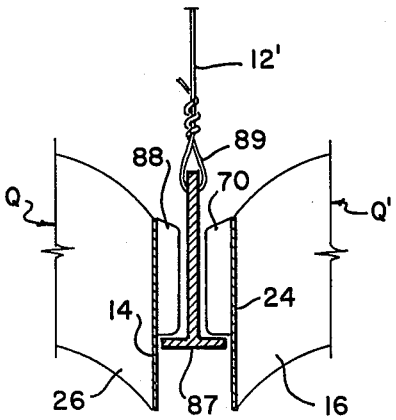
FIG. 9 is a fragmentary sectional view, similar to FIG. 8 but illustrating the use of T-bars for suspension purposes.

The supporting assembly A may be constructed, as in FIGS. 7 and 8, to include not only the beams 11 and 13 and the suspension cables or rods 12, but also a series of arcuate channels 82 which correspond to the outer edges of the sections S. Each of the suspension wires or rods 12 may be provided with a conventional adjustment device 83, by which the elevation of the arcuate channels 82 attached thereto may be adjusted, in order to place the corners of each section S at the same elevation. Such an adjustment device may be a threaded socket associated with threads at the lower end of a rod 12, with the socket threads also receiving a bolt or the like at its lower end which extends through a channel 82 to attach the same thereto and a lock nut for maintaining the socket in adjusted position, or the equivalent. Each channel 82 may be provided with a series of hangers 84, shown on a limited number of channels 82 in FIG. 7 but illustrated in greater detail in FIG. 8. Thus, the hangers 84 may be channel-shaped and provided with an upturned hook 85 at the lower end of each side, each of which engages an appropriate slot 86 in each of an outer plate of two adjacent sections, such as a plate 14 of a quadrant Q' of one section and a plate 24 of a quadrant Q of an adjacent section, as adjacent the intersection of plates 26 and 16, respectively therewith, as in FIG. 8, as well as a single plate along the outer edge of an outside section, in which event only one hook 85 would be necessary. As an alternative, illustrated in FIG. 9, an inverted T-hanger 87 may be utilized, on which a tab 88 at the opposite end of plate 26, from tab 60 of FIG. 2 and tab 70 of plate 16 may rest. Hanger 87 may be suspended from a wire 12' by a loop 89, which may be adjusted to shift hanger 87 upwardly or downwardly. It will be understood that other or equivalent types of hangers may be utilized.

Figure 10:
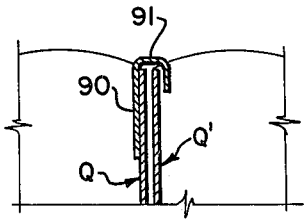
FIG. 10 is a sectional detail, showing the suspension of a removable quadrant from a relatively fixed quadrant.

The abutting edges, as in FIG. 6, of abutting quadrants, such as plates 32 and 22, are preferably connected together, to solidify each section S. However, such connections between a removable quadrant Q and a relatively fixed quadrant Q' are preferably readily disconnectable. Any suitable connection may be used, such as that shown in FIG. 10, which includes an interlocking tab 90 which may be spotwelded to a plate of a more readily removable quadrant Q and having a hook 91 for resting on the top of an adjacent plate of a relatively fixed quadrant Q', so that when quadrant Q is lifted off hook 85 of hanger 84 of FIG. 8, or a T-hanger 87 of FIG. 9, the quadrant Q may be simultaneously moved upwardly with respect to the quadrant Q', then diagonally outward so as to be free of both the hangers and the fixed quadrants Q' on each side. The fixed quadrants Q' may also be supported at the center of each dome section S, as by an additional wire or rod 12' of FIG. 7, depending from a cross beam 13 and a single hanger 92 which extends diagonally to each side of the center for connection with the respective diagonally opposed quadrants Q'.

Although the quadrants and sections of the dome grids of this invention have been illustrated and described as being fabricated from flat planar plates attached togther, it will be understood that a similar construction may be produced, at probably considerably greater expense, by casting; molding or the like in a single piece, particularly when a plastic is the desired material. Also, any embodiment may be perforated, embossed or dimpled for decorative or sound dampening purposes.

Figure 11:
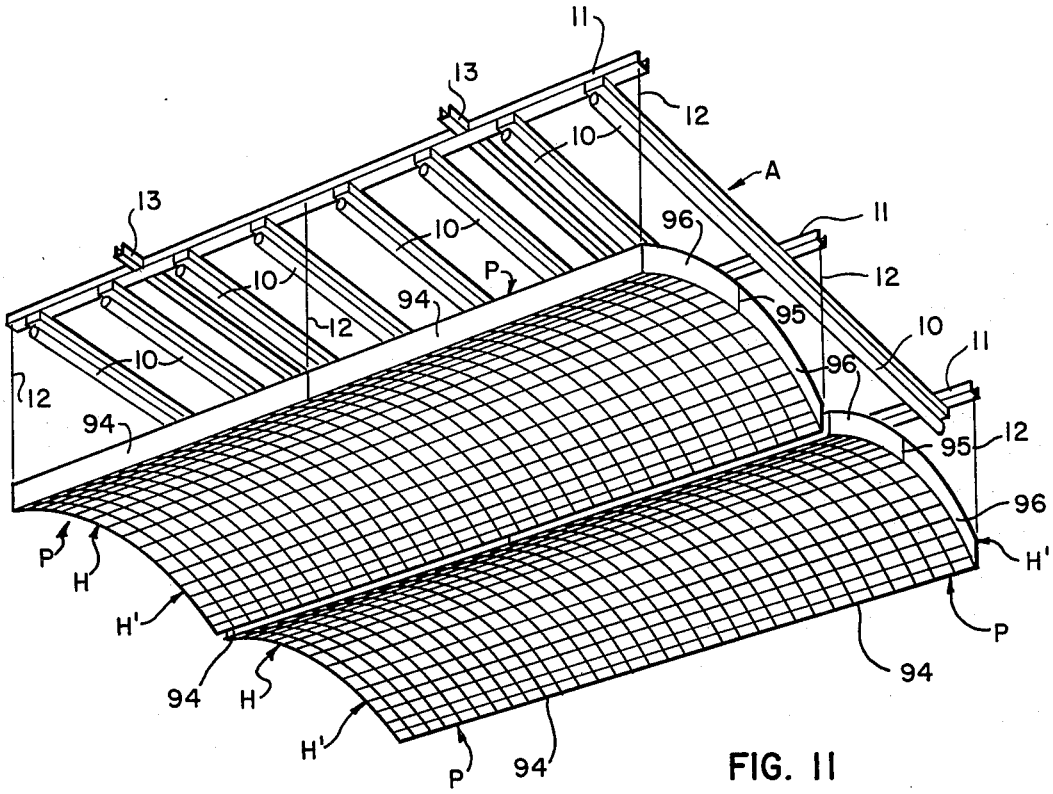
FIG. 11 is an underside perspective view of a ceiling vault grid, of tunnel form rather than dome form but constructed in accordance with this invention.

A tunnel type vault grid, rather than a dome type, may be constructed in accordance with this invention, as illustrated in FIG. 11. A series of two panels P are shown in longitudinal alignment, while a pair of abutting panels P are also shown in longitudinal alignment. Of course, the number of panels P may be increased or decreased in accordance with the area to be covered by the grid or the length and height of the partition, wall decoration or the like, desired. Each panel P may be constructed as a unit or as a half section H abutting another half section H'. As will be evident, the longitudinal edges of the panels P are parallel and the underside as well as the top of each panel curves laterally upwardly from one side and then downwardly to the other.

Each panel P may include, at each side, an edge plate 94 the edges of which are generally straight rather than curved and a center plate 95 the edges of which have a similar generally straight, rather than curved, contour but which may actually comprise two abutting plates of the half sections H and H'. Each end plate 96 of each half section has edges which generally curve upwardly from a side plale 94 to the center plate 95, it being understood that the two end plates 96 shown may be combined into a single end plate. The tunnel type vault grid of FIG. 11 may be supported below a ceiling in a manner similar to that previously described, i.e. below a series of light fixtures 10 supported from longitudinal beams 11, from which the corners of panels P may be supported by wires or rods 12. When support for a central portion of any of the panels P is required, such as to permit the half sections H or H' to be hinged downwardly, the same may be supported from cross beams 13, as in a manner similar to that described previously for the vault grids having a dome shape.

Figure 12:
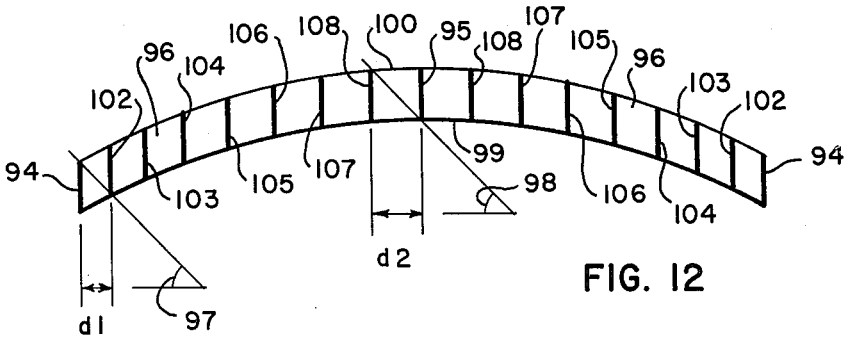
FIG. 12 is a diagrammatic front elevation of a pair of panels of FIG. 11, showing the layout of the panel and a representation of the angles of light interference subtended by the upper and lower edges of adjacent plates.

A layout of panel P of FIG. 11 is illustrated in FIG. 12. The angle of light interception 97, between the top of an edge plate 94 and the bottom of the next adjacent, parallel plate, may be essentially the same as the angle between adjacent edge plates of the previous embodiment. Angle 98, between the center plate 95 and the next adjacent, parallel plate, is again the same angle, although the distance $d_1$, adjacent the edge plates, is less than the distance $d_2$, between adjacent center plates, in the same manner as before. The general contour of the arc of the lower edge of end plate 96 and other plates similar thereto, as well as the general contour of the upper edge 100 of plate 96 and similar plates, may be laid out in generally the same manner as described previously in connection with FIG. 6. Other intersecting plates, i.e. those parallel to edge plates 94 and center plate 95, such as successive plates 102 through 108, between each of the edge plates 94 and center plate 95, are spaced distances apart corresponding to the same light cutoff angle as the angles 97 and 98, as before. It will be noted that each of the plates 94, 102–108 and 95 may be identical in size and shape, as well as being laid out from straight, parallel upper and lower edges. It will be understood, of course, that the spaces between adjacent plates 94, 102–108 and 95 along the arc 99, for plate 96, may be provided with scallops, such as concave, as before, or any other desired configuration, while the upper edges of plate 96 and corresponding plates, again in the spaces betwen plates 94, 102–108 and 95, may also be provided with scallops, such as convex, or any other desired configuration, as along the arc 100, or varying therefrom, either upwardly or downwardly. Similarly, the upper and the lower edges of the spaces between intersections of plates 94, 102–108 and 98, with plate 96 and plates parallel thereto, may be provided with scallops, such as concave at the bottom and convex at the top or any other desired configuration. As before, each series of plates have the same height at points of intersections with the other series of plates. Plates 96 and other plates corresponding thereto may be produced in quantity in the same manner as described before for the curved plates of the dome vault grid structure of the previous embodiment. However, since the plates 94, 102–108 and 95 are essentially straight along the top and bottom, but are identical, another set of dies may be utilized to produce these plates in sequence so that all will normally be identical. It may, of course, be possible to vary the design by different contours of different plates 96 and those corresponding thereto, or plates 94, 102–108 and 95. As indicated previously, a pair of center plates 95 may be utilized, abutting against each other, so that one-half of a panel P may be pivoted or otherwise moved downwardly, for access purposes.

As will be evident, the manner in which the intersecting planar plates of the dome grid of FIGS. 1–10 may be attached together, i.e. by intersecting slots or notches and tabs bent over at the ends, may be utilized with equal facility for the embodiment of FIGS. 11 and 12.

Although more than one embodiment of this invention has been illustrated and described and variations therein illustrated and described, it will be understood that other embodiments and usages may exist and other variations may be utilized without departing from the spirit and scope of this invention.

What is claimed is:

1. A grid adapted to produce a domelike appearance on one side, comprising:

a first series of parallel plates extending in one direction;

a second series of parallel plates extending in a direction to intersect the plates of said first series;

said first and second series of intersecting plates being constructed and arranged whereby one or more sets thereof may be supported in an assembly whose central area is offset on one side to produce a domelike appearance;

both of said series of plates are generally concave on said one side; and each of the outside edges of said grid, on said one side, is generally concave.

2. A grid as defined in claim 1, wherein: both series of plates have the same height at the intersections with the other series of plates.

3. A dome grid as defined in claim 2, wherein:

each series of plates extends generally perpendicular to the other series of plates.

4. A dome grid as defined in claim 3, including:

means for supporting said grid in a generally horizontal position;

illumination means above said grid; and said plates are spaced apart at different distances corresponding to a desired angle of light view cutoff between the top of one plate and the underside of an adjacent plate.

5. A dome grid as defined in claim 1, wherein:

each said assembly comprises a section having four quadrants, each formed by a first and second series of said plates.

6. A dome grid as defined in claim 1, wherein:

one side of said plates of said assembly correspond generally to a concave arc between the outer edges of said assembly.

7. A dome grid as defined in claim 6, wherein:

the radius of said arc corresponds generally to the length of the chord of said arc.

8. A dome grid as defined in claim 1, wherein:

said plates are provided on said one side with a general contour other than an arc corresponding to a concave arc.

9. A dome grid as defined in claim 1, wherein:

said one side of said first and second series of plates of each said set has a plurality of concave configurations.

10. A dome grid as defined in claim 9, wherein:

said concave configurations on said one side of said first and second series of plates extend between adjacent intersecting plates.

11. A dome grid as defined in claim 9, wherein:

the opposite sides of said plates have convex configurations.

12. A dome grid as defined in claim 11, wherein:

said concave configurations on said one side and said convex configurations on said opposite sides of said plates each extend between intersecting plates.

13. A dome grid as defined in claim 12, wherein:

said configurations of the opposite sides of said plates are generally equidistant from the configurations of said one side of said plates.

14. A grid as defined in claim 1, wherein:

said plates are provided with configurations other than concave on one side and configurations other than convex on the opposite side; and said configurations on said one side and on said opposite side of said plates extend between adjacent intersecting plates.

15. A dome grid comprising:

a first series of parallel plates extending in one direction;

a second series of parallel plates extending in a direction to intersect the plates of said first series;

said first and second series of intersecting plates being constructed and arranged whereby one or more sets thereof may be supported in an assembly whose central area is offset on one side to produce a domelike appearance;

both of said series of plates are generally concave on said one side; and each series of plates have the same height at the intersections with the other series of plates.

16. A dome grid as defined in claim 15, wherein:

each series of plates extends generally perpendicular to the other series of plates.

17. A dome grid as defined in claim 16, including:

means for supporting said grid in a generally horizontal position:

illumination means above said grid; and said plates are spaced apart at different distances corresponding to a desired angle of light view cutoff between the top of each plate and the underside of an adjacent plate.

18. A grid adapted to produce a vaultlike appearance on one side, comprising:

a first series of parallel plates extending in one direction;

a second series of parallel plates extending in a direction to intersect the plates of said first series;

said first and second series of intersecting plates being constructed and arranged whereby one or more sets thereof may be supported in an assembly whose central area is offset on one side to produce a tunnel appearance;

one of said series of plates is generally concave on said one side and the other series of plates is generally straight on said one side, with each series of plates having essentially the same height at the intersection with the other series; and the distance between said plates of each series is proportioned so that, when said grid is illuminated from the side opposite such concavity, the angle of view cutoff between the edge of each plate on the side opposite such concavity and the edge of an adjacent plate at such concavity is the same.

19. A grid as defined in claim 18, wherein:

each plate is provided, on the side of such concavity, with a scallop between intersecting plates which is also generally concave.

20. A grid as defined in claim 19, wherein:

each plate is provided on the side opposite such concavity with a convex shape between intersecting plates.

* * * * *